US005283013A

United States Patent [19]

Gerhardy

[11] Patent Number: 5,283,013

[45] Date of Patent: Feb. 1, 1994

[54] MEMBRANE CARBURETOR

[75] Inventor: Reinhard Gerhardy, Korb, Fed. Rep. of Germany

[73] Assignee: Andreas Stihl, Waiblingen, Fed. Rep. of Germany

[21] Appl. No.: 944,337

[22] Filed: Sep. 14, 1992

[30] Foreign Application Priority Data

Sep. 13, 1991 [DE] Fed. Rep. of Germany ..... 4130582

[51] Int. Cl.[5] ..... F02M 17/04

[52] U.S. Cl. ..... 261/35; 261/DIG. 68; 251/333; 251/359

[58] Field of Search ..... 261/35, DIG. 68; 251/359, 333

[56] References Cited

U.S. PATENT DOCUMENTS

| | | | |
|---|---|---|---|
| 2,068,938 | 1/1937 | Viel | 261/DIG. 68 |
| 2,144,017 | 1/1939 | Gistucci | 261/DIG. 68 |
| 2,683,027 | 7/1954 | Garretson | 261/DIG. 68 |
| 2,735,439 | 2/1956 | Coffey | 251/333 |
| 3,009,794 | 11/1961 | Barfod | 261/DIG. 68 |
| 3,219,063 | 11/1965 | Schumann et al. | 251/359 |
| 3,527,246 | 9/1970 | Petersen et al. | 251/333 |
| 3,623,699 | 11/1971 | Matousek et al. | 251/333 |
| 4,235,418 | 11/1980 | Natalizia | 251/359 |
| 4,386,594 | 6/1983 | Szloboda | 261/DIG. 68 |
| 4,793,951 | 12/1988 | Scott | 261/DIG. 68 |
| 4,903,655 | 2/1990 | Vonderau et al. | 261/35 |

FOREIGN PATENT DOCUMENTS

| | | | |
|---|---|---|---|
| 624856 | 9/1961 | Italy | 261/DIG. 68 |

OTHER PUBLICATIONS

The American Heritage Dictionary, Apr. 1982 p. 545.

*Primary Examiner*—Tim Miles
*Attorney, Agent, or Firm*—Walter Ottesen

[57] ABSTRACT

The invention is directed to a membrane carburetor for an internal combustion engine such as a two-stroke engine having an intake for drawing the mixture in by suction. The membrane carburetor has a venturi section wherein the mixture is formed. A main nozzle opening opens forward of a throttle flap and an idle nozzle opening opens rearward of the throttle flap both viewed in flow direction. Both openings are connected via channels to a fuel-filled control chamber to which fuel flows via an inflow channel. An inlet valve is mounted in the inflow channel and has a valve body disposed opposite a valve seat fixed in the housing. The inlet valve is actuated in the opening direction via a control lever by a control membrane delimiting the control chamber. Transverse accelerations are prevented from leading to an opening of the inlet valve by providing a sealing surface on the valve body which coacts with an annular sealing surface disposed on the valve seat and lying parallel to the flat sealing surface on the valve body. The flat sealing surface lies essentially at right angles to the opening direction.

8 Claims, 2 Drawing Sheets

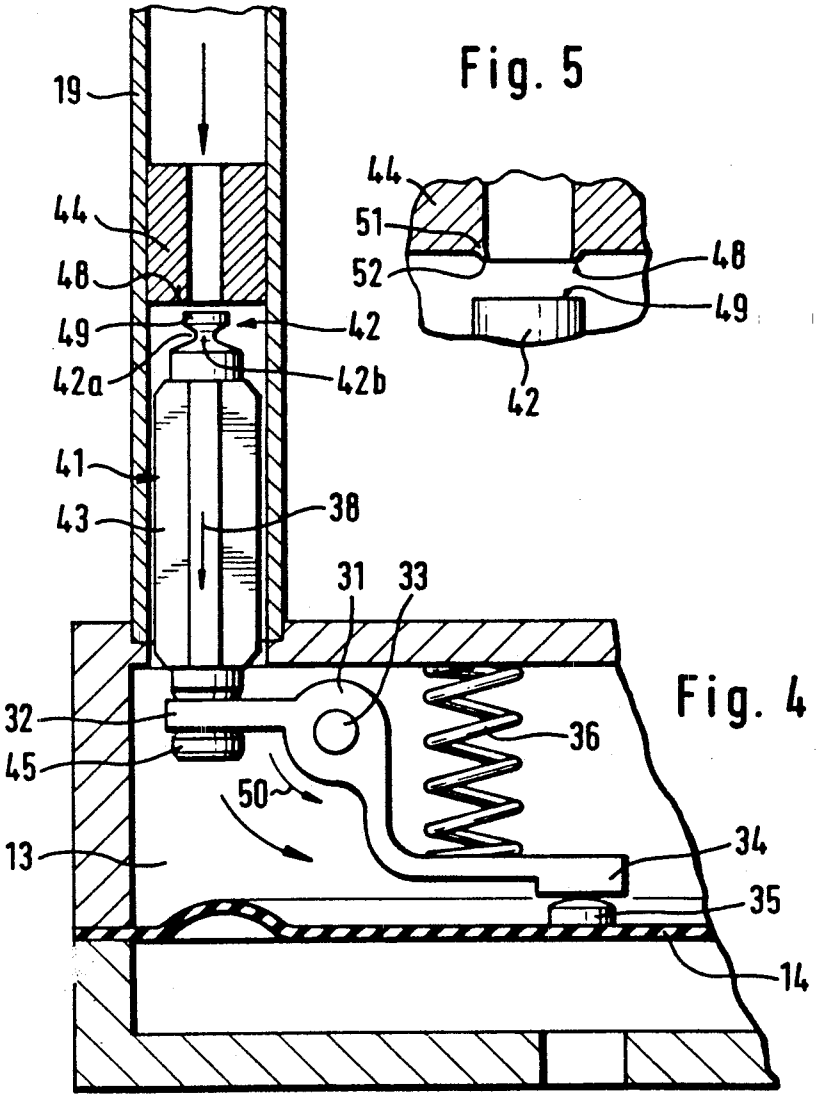
Fig. 5
Fig. 4
19
44
48
49
42a
42
42b
41
43
38
31
33
32
45
13
50
36
34
35
14
51
52
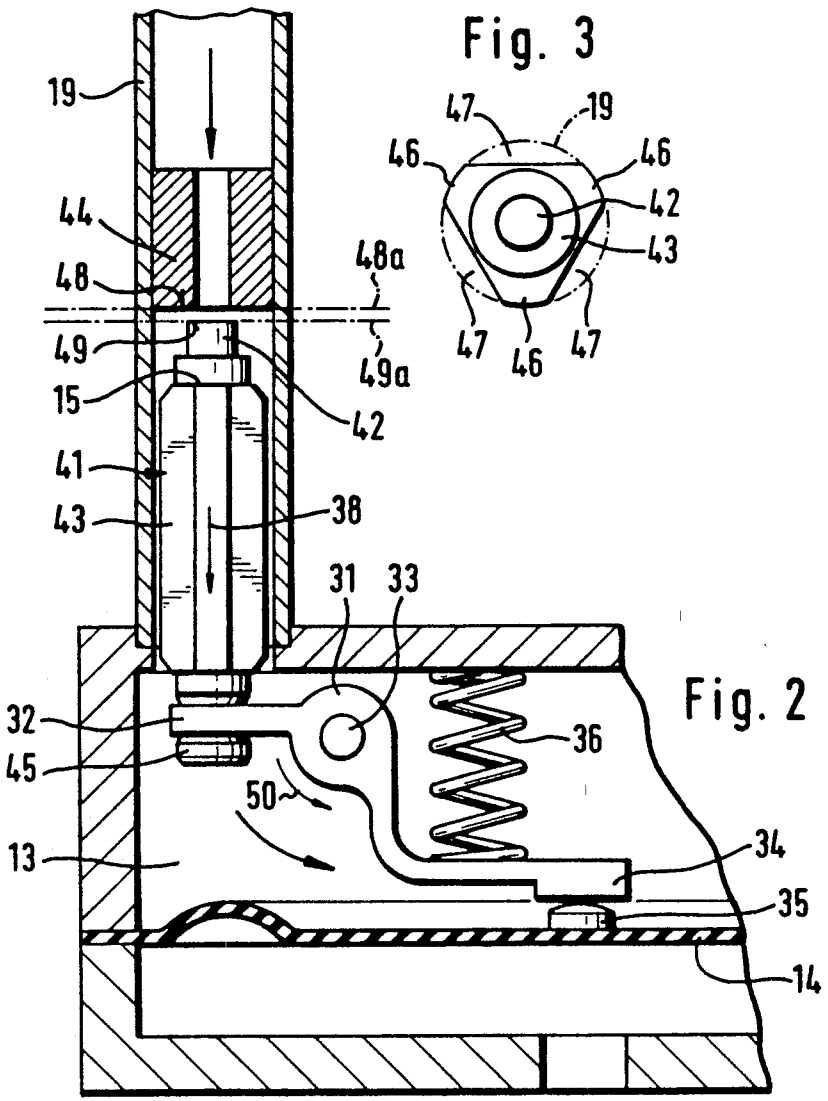
Fig. 3
Fig. 2
19
46
42
43
47
48a
49a
44
48
49
15
41
38
31
33
32
45
13
50
36
34
35
14

MEMBRANE CARBURETOR

FIELD OF THE INVENTION

The invention relates to a membrane carburetor for an internal combustion engine having a mixture intake such as a two-stroke engine in a portable handheld work apparatus such as a chain saw, cutoff machine, brushcutter or the like.

BACKGROUND OF THE INVENTION

A membrane carburetor of the kind referred to above is disclosed in U.S. Pat. No. 4,903,655. The valve member comprises a guide body having a valve body at one end and, at the other end thereof, the guide body is held in a bifurcated holder of a control lever. The control lever is pivotally journalled in the housing of the membrane carburetor. The other end of the control lever is, on the one hand, resiliently biased by a control spring in the direction of closure of the inlet valve and, on the other hand, is actuable by the control membrane against the force of the spring in the direction of opening the inlet valve. The valve member is guided in the stroke direction by the guide body in the feed channel. The guide body is self-supporting in the feed channel with radial play. The guide ribs run in the direction of the feed channel and are arranged over the periphery.

When the internal combustion engine draws combustion air in through the venturi section, fuel leaves through the idle nozzle when the throttle flap is closed whereby an underpressure develops in the control chamber. The control membrane moves into the control chamber and acts on the control lever in the opening direction of the inlet valve. The valve body then lifts away from the valve seat. Fuel then flows into the control chamber to equalize the pressure. After the pressure equalization has taken place, the control membrane moves back into its start position and the inlet valve is closed by the action of the control spring. This alternating action ensures that the control chamber is filled with fuel having a pressure level in the vicinity of atmospheric pressure.

The vibrations of the internal combustion engine which occur at idle also act on the carburetor even when this is mounted so as to be decoupled from the engine. These vibrations impart corresponding acceleration forces to the valve member and these vibrations can lead to an unwanted opening of the inlet valve whereby too much fuel enters into the control chamber which is then supplied in an uncontrolled manner to the venturi section via the openings so that the mixture becomes enriched. It is especially at idle that the uncontrolled fuel inflow (main nozzle drip) leads to enrichment of the mixture and therefore to fluctuations in the idle engine speed such as a drop in engine speed and, in the extreme case, causing the engine to die because of overenrichment. The engine must then be started anew.

Based on theoretical considerations, acceleration forces act because of the vibrations on the valve member transversely to the opening direction and in the opening direction. The acceleration forces acting in the opening direction can be compensated by an appropriately dimensioned control spring. Acceleration forces occurring transversely to the opening direction cannot be transmitted directly to the inner wall of the feed channel since the guide body is guided in this channel with radial play. For this reason, acceleration forces acting transversely to the opening direction lead to a radial displacement of the valve member so that the valve cone is pressed against the valve seat transversely to the opening direction. The acceleration force is then distributed in accordance with a vector diagram and a further force results acting in the opening direction. To compensate for this force, the control spring must be correspondingly stronger dimensioned. A control spring which is dimensioned too strong however influences the formation of the mixture and therefore the operating performance of the engine since a higher underpressure must then be present in the venturi section for opening the inlet valve to the control chamber and this higher underpressure must be developed by the engine.

On the other hand, the radial play of the guide body in the inlet channel can be dimensioned smaller in order to obtain a better bracing of the transverse forces on the inner wall of the inlet channel. These theoretical considerations have been substantiated in laboratory operation; however, in practice, it has been determined that the slight radial play leads to an early freezing of the guide body in the feed channel since dirt particles are always conveyed with the fuel. For example, with tank venting, the finest dust can penetrate which over time causes the guide body to become seized and renders the membrane carburetor inoperable. Accordingly, to prevent seizure of the valve member, a specific radial play may not be reduced below a specific value.

In modern motor-driven chain saws, the carburetor is mounted separately from the engine in the housing of the chain saw such as in the handle because of thermal considerations. The carburetor then is connected to the engine via elastic channels. Decoupled carburetors of this type are greatly subjected to different vibrations depending upon peripheral conditions. The carburetor of a motor-driven chain saw is set in the test stand after manufacture. The idle engine speed is stable below the coupling speed of the centrifugal clutch which drives the saw chain. In practice, this setting has proven successful when the motor-driven chain saw is held in the hand. However, if the operator sets the motor-driven chain saw down for example on a concrete surface, then vibrations having an increased amplitude occur in the carburetor which impart corresponding accelerating forces on the valve member whereby the inlet valve opens in an uncontrolled manner. Main nozzle drip occurs and the idle engine speed changes greatly or the machine dies. When the motor-driven chain saw is set down on the forest ground, then different vibration and force relationships occur. A setting of the membrane carburetor to a constant idle engine speed which is influenced only slightly by occurring vibrations is hardly possible.

SUMMARY OF THE INVENTION

It is an object of the invention to provide a membrane carburetor of the kind described above wherein the most different vibrations of changing amplitude do not lead to a significant opening of the inlet valve when a control spring adapted to the engine is utilized. It is another object of the invention to provide such a membrane carburetor wherein main nozzle drip during idle is substantially prevented.

The membrane carburetor of the invention is for an internal combustion engine such as a two-stroke engine wherein a fuel mixture is drawn in by suction. The membrane carburetor includes: a carburetor housing; a venturi section formed in the housing and defining a flow direction for the combustion air and air/fuel mixture; a choke flap mounted in the venturi section and a throttle flap mounted in the venturi section downstream of the choke flap viewed in the flow direction; the carburetor housing further defining an interior space; a displaceable control membrane disposed in the interior space so as to form a control chamber therein bounded by the membrane; the venturi section having a main nozzle opening formed therein forward of the throttle flap and an idle nozzle opening formed therein rearward of the throttle flap viewed in the flow direction; first and second channels respectively connecting the main nozzle opening and the idle nozzle opening to the control chamber and through which fuel can flow to cause changes in pressure in the control chamber thereby displacing the control membrane; a fuel-feed channel for conducting fuel into the control chamber; an inlet valve for metering fuel from the fuel-feed line into the control chamber; the valve including: a valve seat disposed in the channel and a valve body movable along an opening axis between a first position wherein the valve body is in contact engagement with the valve seat to interrupt the flow of fuel into the control chamber and a second position away from the valve seat to allow fuel to flow into the control chamber; control lever means interconnecting the valve body and the control membrane for transmitting the displacement of the control membrane to the valve body to move the valve body into the second position; the valve body having a sealing surface formed thereon which lies essentially at right angles to the opening axis; and, the valve seat defining an annular sealing surface extending parallel to the sealing surface of the valve body.

Because of the flat valve seat, occurring transverse forces lead only to a radial displacement of the valve member without an opening force being applied thereby to the valve member. The dimensioning of the overlapping sealing surfaces is obtained while considering the possible radial displacement of the valve member because of the radial play in the inlet channel which must necessarily be provided so that radial displacement of the valve member cannot lead to an opening of the inlet valve. The main nozzle drip is effectively prevented and the set idle engine speed remains constant.

An adapted dimensioning of the annular surface at the valve seat and the adjustment of a slightly overlapping sealing surface between valve body and valve seat makes a stroke throughflow ratio possible which corresponds to that of a valve cone of the state of the art. For this reason, the same control performance is obtained as with a valve cone.

The overlapping sealing surface is dimensionally very small and the diameters here are in the range of 0.6 to 1.2 mm. The outer diameter of the valve body is then configured to correspond to the outer diameter of the smallest necessary annular sealing surface. The small dimensions ensure that small angle errors between the annular sealing surface on the valve seat and the flat sealing surface on the valve body do not lead to leakage. In addition, the valve body is advantageously made of an elastic material such as rubber so that angle errors can be compensated by the elasticity.

The valve body is preferably a cylindrical lug with an undercut being provided between the sealing surface and the valve member to increase the elasticity of the cylindrical lug. The undercut is preferably configured as a peripheral annular slot.

The valve seat is coated galvanically with especially chromium or nickel to form an annular seat surface on the valve seat as small as possible. The galvanic coating causes an axial bead to be formed on the inner edge of the valve seat which is used as the annular seat surface. When the sealing surface of the valve body lies on this bead, a line contact essentially occurs and therefore a minimum surface contact which ensures a good seal.

BRIEF DESCRIPTION OF THE DRAWINGS

The invention will now be described with reference to the drawings wherein:

FIG. 2 is an enlarged detail view showing the inlet valve to the control chamber of the membrane carburetor;

FIG. 3 is an end view of the valve member of the inlet valve;

FIG. 4 is an enlarged detail view of the inlet valve according to another embodiment of the invention; and, FIG. 5 is an enlarged detail schematic showing a galvanically coated valve seat.

DESCRIPTION OF THE PREFERRED EMBODIMENTS OF THE INVENTION

Figure 1:
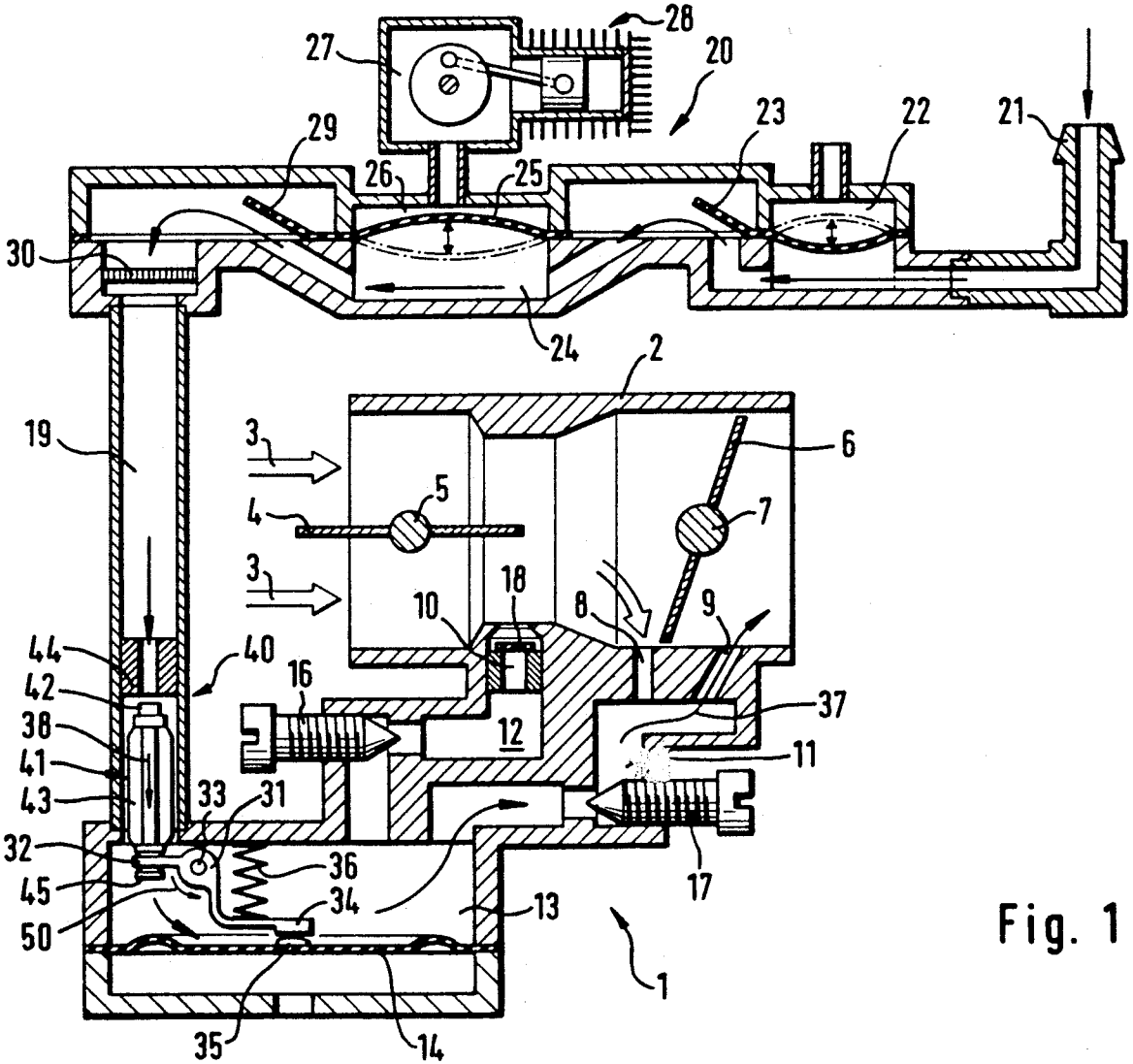
FIG. 1 is a schematic representation of a membrane carburetor according to the invention having a control chamber supplied by a membrane fuel pump.

The membrane carburetor 1 shown in FIG. 1 is especially for internal combustion engines of portable handheld work apparatus such as motor-driven chain saws, cutoff machines, brushcutters or the like. The membrane carburetor 1 essentially comprises a venturi channel 2 which is flange connected to the intake stub of the internal combustion engine 28 and especially a two-stroke engine. A starter flap 4 and a throttle flap 6 are mounted in the venturi channel 2 one behind the other when viewed in flow direction 3. The starter flap 4 and the throttle flap 6 are pivotally journalled on a starter flap pivot pin 5 and a throttle flap pivot pin 7, respectively. In the embodiment shown, the throttle flap 6 is in idle position and the starter flap 4 is in the open position.

A main nozzle opening 10 opens into the channel 2 rearward of the starter flap 4 and forward of the throttle flap 6 in the region of the venturi channel viewed in flow direction. An idle nozzle opening 9 opens into the venturi channel 2 rearward of the throttle flap 6 viewed in flow direction 3.

The openings 9 and 10 are connected via channels 11 and 12, respectively, to a fuel-filled control chamber 13 which is provided in the housing of the membrane carburetor 1 and is delimited by a control membrane 14. The control membrane 14 is charged with atmospheric pressure on the side thereof facing away from the control chamber 13.

The throughflow quantity of the idle nozzle channel 11 to the idle nozzle opening 9 can be adjusted via an idle screw 17. A bypass bore 8 opens into the idle nozzle channel 11 downstream of the idle screw 17. During idle, air from the channel 2 enters through the bypass bore 8 from the region forward of the throttle flap 6 so that a fuel emulsion exits via the idle nozzle opening 9 in the direction of arrow 37.

Correspondingly, a full load screw 16 is provided in the main nozzle channel 12 for adjusting the maximum throughflow through the main nozzle channel 12. In addition, the main nozzle opening 10 is closed by a valve platelet 18 which opens in the venturi channel 2 in the manner of a check valve and tightly closes the main nozzle opening 10 during idle because of the pressure relationships present.

Fuel is supplied to the control chamber 13 via an inflow channel 19. The fuel is pumped from a fuel tank (not shown) via an intake stub 21 by a membrane fuel pump 20. From the intake stub 21, the fuel first flows into an equalization chamber 22 and from there flows via a check valve 23 configured as a flap valve into the pump chamber 24 of the fuel pump 20. The pump chamber 24 is partitioned by a membrane 25 from a drive chamber 26 of the fuel pump 20. The drive chamber 26 communicates with the crankcase 27 of the two-stroke engine 28 supplied by the membrane carburetor and is charged alternately by the crankcase inner pressure.

If an underpressure is present in the crankcase 27, then the membrane 25 arcuately deflects into the position shown by the solid black line whereby the volume of the drive chamber 26 is reduced and an underpressure is generated in the pump chamber 24. For this reason, fuel is drawn by suction into the pump chamber 24 via the check valve 23 (suction valve) which opens.

When the inner pressure in the crankcase changes to positive pressure values, then the membrane 25 deflects in the sense of a volume reduction of the pump chamber 24 and the fuel in the pump chamber is charged with pressure. The check valve 23 closes and a check valve 29 mounted on the pressure side of the fuel pump 20 opens. The check valve 29 is likewise configured as a flap valve. The fuel is conveyed through a fine filter 30 into the inflow channel 19 to the control chamber 13.

An inlet valve 40 is arranged in the inflow channel 19 forward of the opening into the control chamber 13. The inlet valve 40 is configured as a flat-seat valve and comprises a valve member 41 and a valve body 42. A valve seat 44 is fixed in the housing and coacts with the valve body 42. The valve member 41 projects with its end 45 facing away from the valve body 42 into the control chamber 13 and is held in a bifurcated end 32 of a control lever 31. This holding connection is so effected that the valve member 41 is held essentially free of play in the bifurcated end 32 in the longitudinal direction of the valve member; whereas, relative movements between the valve member 41 and the bifurcated end 32 are possible transversely to this longitudinal direction.

The control lever 31 is pivotally held on a bearing 33 fixed in the housing. The end 34 of the lever 31 lies opposite the center 35 of the control membrane 14. A control spring 36 fixedly braced on the housing acts on the end 34 of the control lever 31 to resiliently bias the valve member 41 in the direction of closure.

In the shown idle position of the membrane carburetor (throttle flap 6 closed), the fuel enters into the venturi channel 2 exclusively via the idle nozzle opening 9 disposed rearward of the throttle flap 6 viewed in flow direction 3 (arrow 37). An underpressure develops in control chamber 13 because of the fuel flowing out of the control chamber 13 via the idle nozzle opening 9. For this reason, the membrane 14 arcuately deflects into the control chamber 13, acts with its center 35 on the end 34 of the control lever 31 and pivots (arrow 50) the control lever in the opening direction 38 of the valve member 41 against the force of the spring 36. The fuel pumped by the membrane fuel pump 20 flows under pressure via the feed channel 19 and the inlet valve 40 into the control chamber 13 so that the control membrane 14 is returned to its rest position. The control lever 31 is pivoted opposite to the direction of arrow 50 under the force of the control spring 36 whereby the valve member 41 is returned and the valve body 42 is in seal-tight contact engagement with the valve seat 44. The inlet valve 40 is closed.

When an underpressure again builds up in the control chamber 13, the inlet valve 40 is again opened in order to let fuel flow in. This alternate action ensures a control chamber 13 continuously filled with fuel with the overall setting being so provided that approximately atmospheric pressure or a slight underpressure is present in the control chamber 13 during idle so that the valve platelet 18 of the main nozzle opening 10 is seated to provide a seal-tight closure for preventing an outflow of fuel. If this inlet valve 40 would open in an uncontrolled manner, the fuel would flow under pressure into the control chamber 13 and the build-up of overpressure would lead to an uncontrolled exit of fuel at the main nozzle opening 10. The disadvantageous main nozzle dripping would then occur.

In FIG. 2, the inlet valve 40 of FIG. 1 is shown enlarged. The valve member 41 comprises a guide body 43 having the cross section shown in FIG. 3. The guide body 43 comprises a cylindrical base body having guide ribs 46 as shown in FIG. 3. The guide ribs run in the longitudinal direction of the guide body 43 and lie at equal spacings about the periphery of the guide body. In the embodiment shown, three guide ribs 46 are arranged and extend over the entire length of the guide body 43. The outer contact surfaces extend over a periphery of approximately 35°. The fuel flows past the guide body through the intermediate spaces 47 delimited by the guide ribs 46.

At one end 45, the guide body 43 is held in the bifurcated end 32 of the control lever 31; whereas, the other end 15 carries the valve body 42. In the embodiment shown, the valve body 42 is configured as a cylindrical lug which is made of an elastic material preferably rubber. In FIG. 2, the free end of the cylindrical lug is configured to have a smaller diameter. The lug however can also have a constant diameter. The sealing surface 49 of the valve body 42 is mounted on the free end and lies in a plane **49*a* which is at right angles to the opening direction 38. The longitudinal center axis of the valve member 41 is preferably perpendicular to the plane 49*a***.

The annular sealing surface 48 is configured on the valve seat 44 and faces toward the valve body 42. The annular sealing surface 48 lies in a plane **48*a* which likewise lies at right angles to the opening direction 38, that is, parallel to the plane 49*a*. The longitudinal center axis of the valve seat 44 is perpendicular to the plane 48*a*. In the balanced rest position of the inlet valve 40, the longitudinal center axis of the valve seat 44 lies so as to be coincident to the longitudinal center axis of the valve member 41. The annular sealing surface 48 is reduced to the smallest possible dimension. The outer diameter of the free end of the valve lug is configured to be equal to the smallest necessary outer diameter of the annular sealing surface. The overlapping of the sealing surface 49 of the valve lug 42 and the annular sealing surface 48 of the valve seat 44 is then so provided that a lateral displacement of the valve member 41 does not lead to an opening of the inlet valve. The valve member 41 is guided with radial play in the feed channel 19. The width of the mutually overlapping sealing surfaces is then determined by the radial play of the guide body 43 in the inflow channel 19**.

Possible angle errors between the annular sealing surface 48 and the sealing surface 49 of the valve body 42 have no effect on operation because of the dimensionally small configuration. A seal-tight seating over the entire annular sealing surface is ensured because the valve body 42 is made of an elastic material especially rubber.

An undercut is provided directly behind the sealing surface 49 in order to ensure that even under the most unfavorable conditions, a seal-tight seating of the valve body 42 on the valve seat 44 takes place. The undercut is preferably in the form of a peripheral annular slot 42*a*. In this way, a seal plate is provided which is held on the guide body 43 via a central stem 42*b*. Because of the configuration from elastic material (rubber), the central axial stem 42*b* has a high elasticity so that angle errors are compensated by a corresponding deviation of the seal plate having the sealing surface 49.

In a preferred embodiment, the valve seat 44 is galvanically coated, for example, galvanically nickeled or galvanically chromed. Because of the galvanic plating, an annular bead 52 is formed on the inner peripheral edge 51 of the valve seat 44 as shown in FIG. 5. The annular bead 52 defines the annular sealing surface 48 of the valve seat 44. A special processing of the valve seat for obtaining a planar annular sealing surface is then unnecessary. The valve body 42 seated on the annular bead 52 contacts the bead essentially only via a line so that a kind of line seal is obtained with minimal surface overlapping with the line seal being insensitive to small angle errors. The bead which perforce occurs during galvanic coating has previously been viewed as disadvantageous but is utilized advantageously in the flat seat valve 40 of the membrane carburetor of the invention.

It is understood that the foregoing description is that of the preferred embodiments of the invention and that various changes and modifications may be made thereto without departing from the spirit and scope of the invention as defined in the appended claims.

What is claimed is:

1. A liquid fueled membrane carburetor for an internal combustion engine such as a two-stroke engine wherein a fuel mixture is drawn in by suction, the membrane carburetor comprising:

a carburetor housing;

a venturi section formed in said housing and defining a flow direction for the combustion air and air/fuel mixture;

a choke flap mounted in said venturi section and a throttle flap mounted in said venturi section downstream of said choke flap viewed in said flow direction;

said carburetor housing further defining an interior space;

a displaceable control membrane disposed in said interior space so as to form a control chamber therein bounded by said membrane;

said venturi section having a main nozzle opening formed therein forward of said throttle flap and an idle nozzle opening formed therein rearward of said throttle flap viewed in said flow direction;

first and second channels respectively connecting said main nozzle opening and said idle nozzle opening to said control chamber and through which fuel can flow to cause changes in pressure in said control chamber thereby displacing said control membrane;

a fuel-feed channel for conducting fuel into said control chamber;

said fuel-feed channel defining a longitudinal axis;

an inlet valve for metering fuel from said fuel-feed channel into said control chamber; said valve including: a valve seat disposed in said fuel-feed channel and an elongated guide body having first and second ends; said guide body having a valve body on said first end for coacting with said valve seat and said guide body being arranged in said fuel-feed channel so as to be movable along said axis between a first position wherein said valve body is in contact engagement with said valve seat to interrupt the flow of fuel into said control chamber and a second position away from said valve seat to allow fuel to flow into said control chamber;

control lever means connected to said second end of said guide body and interconnecting said guide body and said control membrane for transmitting the displacement of said control membrane to said guide body to move said guide body into said second position and said valve body into sealing contact engagement with said valve seat;

said elongated guide body having an outer surface extending parallel to said axis and said outer surface defining a plurality of ribs likewise extending parallel to said axis for guiding said guide body in said channel with radial play relative to the wall of said fuel-feed channel as said guide body moves between said positions;

each two mutually adjacent ones of said ribs defining a passage between said first and second ends so as to permit inflowing fuel to flow past said guide body and into said control chamber when said guide body is in said second position;

said valve body being an elastic lug having a free end face defining a flat sealing surface which lies substantially at right angles to said longitudinal axis in both of said positions of said guide body;

said guide body having an outer diameter and said lug having an outer diameter less than said outer diameter of said guide body;

said valve seat defining an annular sealing surface lying approximately parallel to said flat sealing surface; and, said outer diameter of said lug corresponding at least to the outer diameter of the smallest annular sealing surface on said valve seat necessary to permit an effective seal to be established notwithstanding said radial play.

2. The membrane carburetor of claim 1, said material being rubber.

3. The membrane carburetor of claim 1, said lug being a cylindrical lug.

4. The membrane carburetor of claim 1, said lug having an undercut formed therein below said sealing surface permitting said lug to deflect somewhat and ensure a tight seal between said sealing surfaces when said guide body is in said first position.

5. The membrane carburetor of claim 4, said lug having a peripheral side wall extending up to said flat sealing surface thereof; and, said undercut being an annular groove formed in said side wall.

6. The membrane carburetor of claim 1, said annular sealing surface of said valve seat being galvanically coated with a metal.

7. The membrane carburetor of claim 6, said metal being nickel.

8. The membrane carburetor of claim 6, said metal being chromium.

* * * * *